US005761748A

United States Patent [19]

Smith et al.

[11] Patent Number: 5,761,748

[45] Date of Patent: Jun. 9, 1998

[54] SIPHON FOR TANK TYPE TOILET

[76] Inventors: Wade W. Smith, 3311 Round Hill Rd., Branchburg, N.J. 08876; David A. Saar, 8 Bennington Dr., Lawrenceville, N.J. 08648

[21] Appl. No.: 805,762

[22] Filed: Feb. 25, 1997

[51] Int. Cl.[6] ..... E03D 1/14

[52] U.S. Cl. ..... 4/325; 4/313; 4/368; 4/324

[58] Field of Search ..... 4/325, 324, 368, 4/377, 372, 313, DIG. 3

[56] References Cited

U.S. PATENT DOCUMENTS 4,707,867 11/1987 Kawabe et al. ..... 4/313

5,685,027 11/1997 Jensen ..... 4/368

*Primary Examiner*—David J. Walczak

*Attorney, Agent, or Firm*—Spencer T. Smith

[57] ABSTRACT

A siphon for use with a flush type toilet having a tank with a drain hole at the bottom. The siphon comprises a vertical tubular discharge portion including a vertical tube which is secured within the drain hole in the bottom of the tank. The siphon also includes a bell shaped inlet portion including a connecting portion having a downwardly extending tubular portion for telescopic insertion into the vertical tube. A hole is defined in the bell shaped inlet portion and an elbow is secured within the hole and extends downwardly, terminating at a height selected to define the desired flush height of the toilet. The flush volume can be automatically set to either a normal or low volume flush with a control that includes a sensor that senses the presence of a user at the toilet.

11 Claims, 5 Drawing Sheets

SIPHON FOR TANK TYPE TOILET

BACKGROUND OF THE INVENTION

The present invention relates to a tank type toilet and more particularly to a siphon system for controlling the flush volume of a tank type toilet.

A conventional-siphon has a bell shaped inlet portion on one side, a vertical tubular discharge portion on the other side, and a connecting portion connecting the top of these portions. The bottom outlet of the vertical tubular discharge portion is sealingly connected to the discharge opening of the toilet tank. In the ready condition, water fills the bell shaped inlet portion up to the water line of the tank, which is about ½" below the overflow height.

A plunger extends through the top of the bell shaped inlet portion and is connected to an inlet grid. The inlet grid conforms to the shape of the bell shaped inlet portion so that it can be lifted into the bell shaped inlet portion when the flush handle is operated (a "C" link connects the flush handle to the top of the plunger). A compression spring is located on the plunger between the top of the bell shaped inlet portion and the inlet grid to keep the grid at the bottom of the bell shaped inlet portion except when the flush handle is operated. Secured centrally to the top of the grid around the plunger is a flexible plastic cover the shape of the grid. When the flush handle is operated, the plastic covered grid is elevated pushing water out of the bell shaped inlet portion into the vertical outlet portion to establish the siphon which pulls water from the tank, past the flexible plastic cover, which folds out of the way, until the water level of the tank either reaches the bottom of the bell shaped portion or reaches a hole defined in the side of the bell shaped inlet portion. Such conventional siphons accordingly have a single fixed flush volume.

OBJECT OF THE INVENTION

To conserve water, conventional gravity, drain toilets have been modified so that the flush can be selected to have either the normal flush volume (1.6 gallons) or a reduced flush volume.

It is accordingly an object of the present invention to provide an improved siphon operated toilet which can be selectively flushed with either the normal flush volume or with a reduced flush volume.

Other objects and advantages of the present invention will become apparent from the following specification and the accompanying drawings which illustrate in accordance with the mandate of the patent statutes a presently preferred embodiment of the present invention.

DETAILED DESCRIPTION OF THE PREFERRED EMBODIMENT

Figure 1:
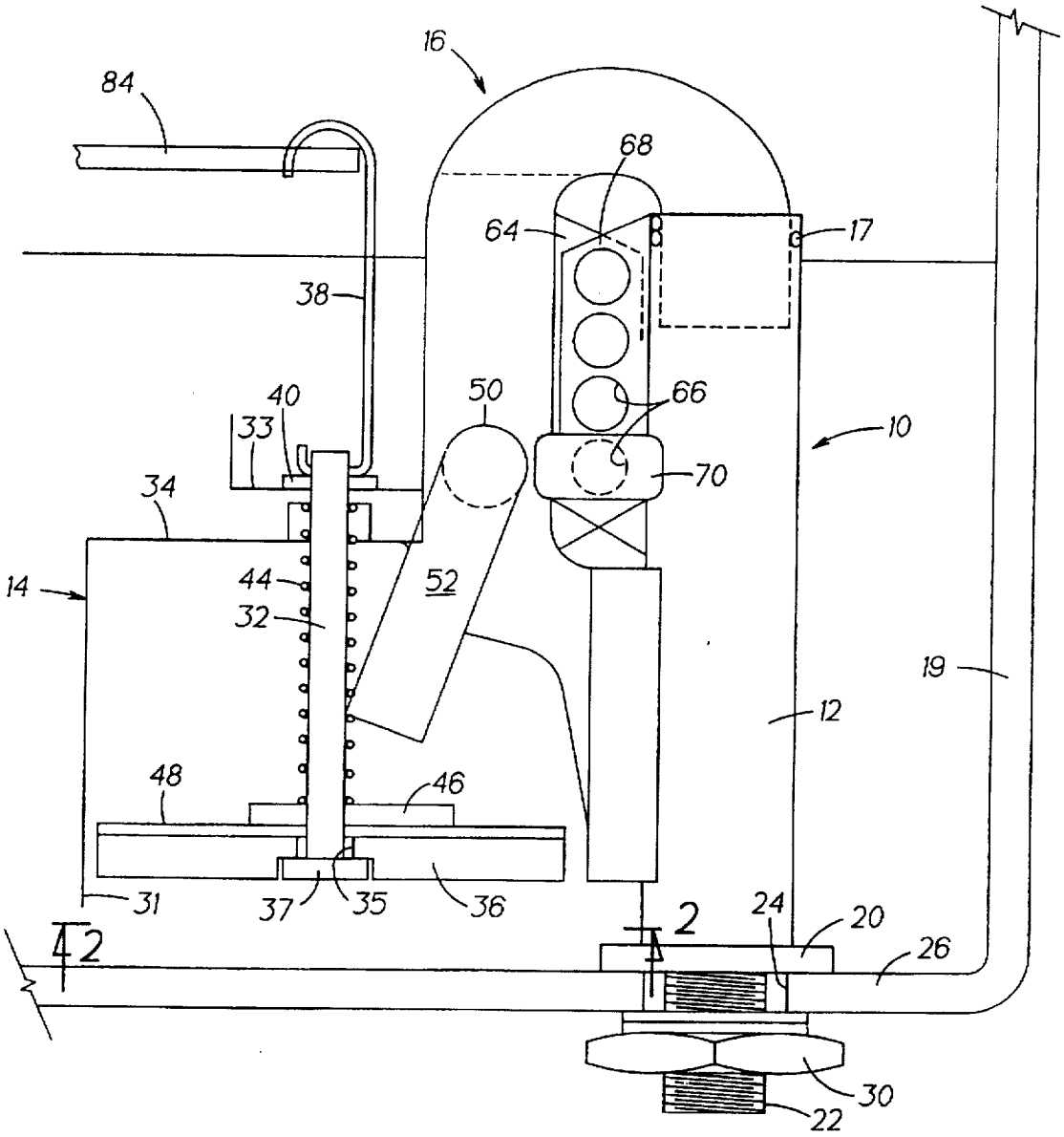
FIG. 1 is an elevational view of a portion of a flush type toilet made in accordance with the teachings of the present invention.

The siphon 10 has a plastic vertical tubular discharge portion 12 which extends upwardly beyond the water level and flares slightly, downwardly and an inlet portion including a plastic bell shaped portion 14 and an integral connecting portion 16 which extends upwardly beyond the water line and then downwardly telescopically into the vertical tubular discharge portion (a seal therebetween may be established by an "O" ring 17 and the connecting portion can be key locked, like the inlet leg of a Hunter fill valve). As shown in FIG. 1, the water line is located about ½" below the overflow height. The vertical discharge tubular portion may have a height of from about 7½" to 11½" and will be cut to locate the top above the water line. The bottom outlet of the vertical tubular discharge portion has a flange 20 at the top of a threaded end 22 so that it can be sealingly connected to the discharge opening 24 of the bottom 26 of the toilet tank 19 by tightening a suitable nut 30.

The bell shaped portion 14 has a horizontal intake opening 31 and in the ready condition, water fills the inlet portion up to the water line of the tank. A plastic plunger 32 extends through a horizontal platform 33 defined on the top wall 34 of the bell shaped portion and through a suitable hole 35 in a plastic inlet grid 36. The bottom of the plunger ends with a stop 37. The inlet grid matches the shape (internal configuration) of the bell shaped portion so that it can be vertically lifted into the bell shaped portion when a flush handle is operated (a "C" link 38 connects the top of the plunger to the flush arm 84 of the flush handle assembly). A plastic washer 40 and is located about the plunger at its top below the "C" link and a compression spring 44 is located around the plunger between the horizontal platform 33 of the bell shaped inlet portion and the inlet grid to keep the grid at the bottom of the bell shaped inlet portion when the siphon is not being used. Secured centrally to the top of the grid around the plunger between a clamping plate 46, which has holes which forcefully receive suitable projections on the top of the grid and the grid, is a flexible plastic cover 48 made from sheet plastic and having the shape of the grid. When the flush handle is operated, the plastic covered grid is elevated pushing water out of the inlet portion and into the vertical outlet portion to establish the siphon which pulls water from the tank, past the plastic cover, which folds out of the way, until the siphon is broken.

A hole 50 is molded into the side wall of the connecting portion 16, approximately 2½" below the water line and a plastic elbow 52 having a circumferential lip 54 at its end is inserted into this hole with the elbow facing downward. The elbow has a length which can be cut to locate the bottom opening of the elbow at a location which will define a flush height (the distance between the water line and the bottom opening of the elbow which will define the normal flush volume (1.6 gallons) in the specific toilet tank 19 in which it is located (or the one of a plurality of elbows having different heights which correlate to specific toilets, can be installed to define this flush height for a specific tank). The elbow can be rotated while maintaining an effective seal between the elbow and the connecting portion.

Figure 2:
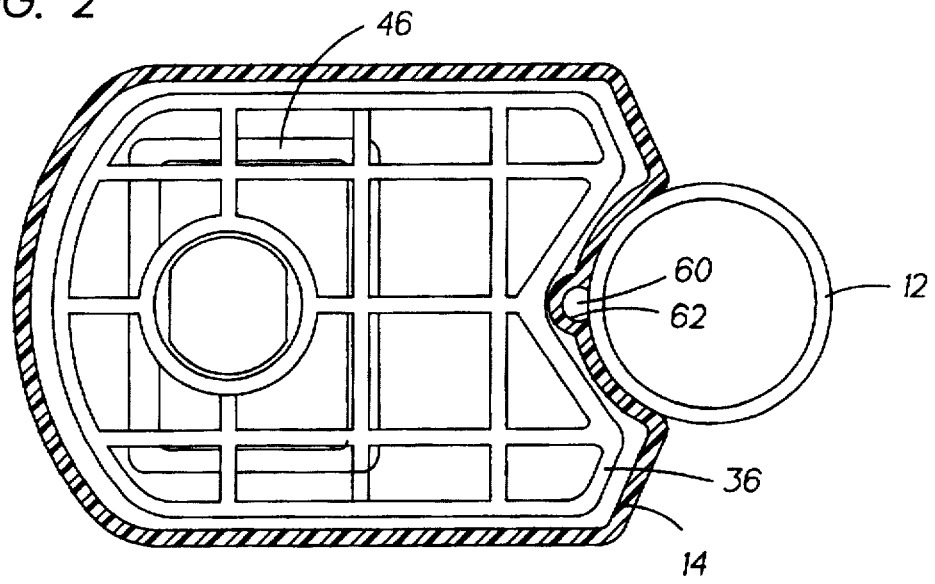
FIG. 2 is a view taken at 2—2 of FIG. 1.
Figure 3:
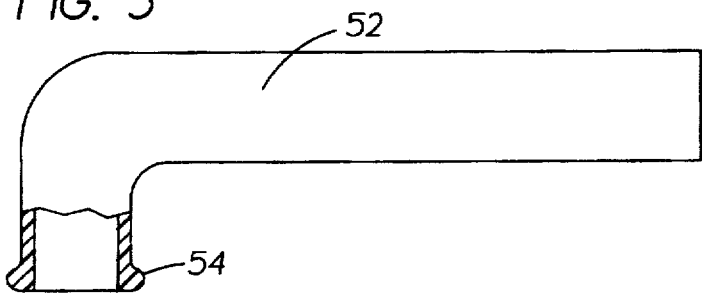
FIG. 3 is a side elevational view of the elbow.

An outwardly projecting key 60 (FIG. 2) extends vertically upwardly along the outside of the vertical tubular discharge portion 12 and is received by a vertical keyway 62 defined in the outer surface of the bell shaped portion. Extending outwardly from the connecting portion is a bracket 64 which includes a number of bores (not shown) which are aligned with corresponding bores 66 which are part of a second bracket 68 extending outwardly from the vertical tubular discharge portion. A connection pin 70 can be forcefully pushed through any two aligned bores to connect the parts together thereby enabling the top of the vertical discharge portion, wherever it has been cut to be connected to the inlet portion.

Figure 4:
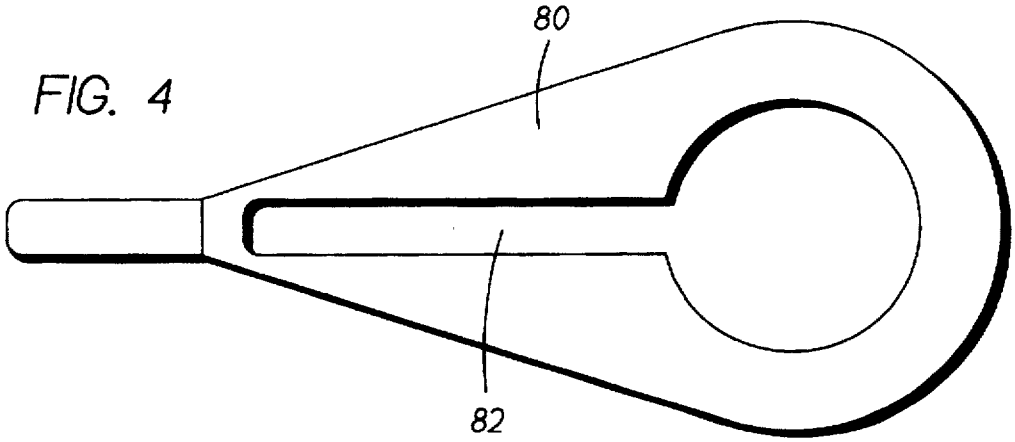
FIG. 4 is a front view of a two piece flush handle.

The toilet may have a two piece flush handle 80, 82, (FIG. 4) with the outer handle 80 actuating a normal flush and the inner handle 82 actuating a reduced volume flush. The outer handle 80 is connected to a spindle 83 (FIG. 5) which passes through the tank wall and which is integral with an extended flush arm 84. The upper end of the "C" shaped link 38 is connected, directly or indirectly, to the free end 85 of this flush arm 84 so that when this outer flush handle is operated, the grid will be elevated sufficiently to establish the siphon to flush the toilet. The breaking of the siphon, when the water level decreases to the opening of the elbow, will define the normal flush volume (1.6 gallon).

Figure 5:
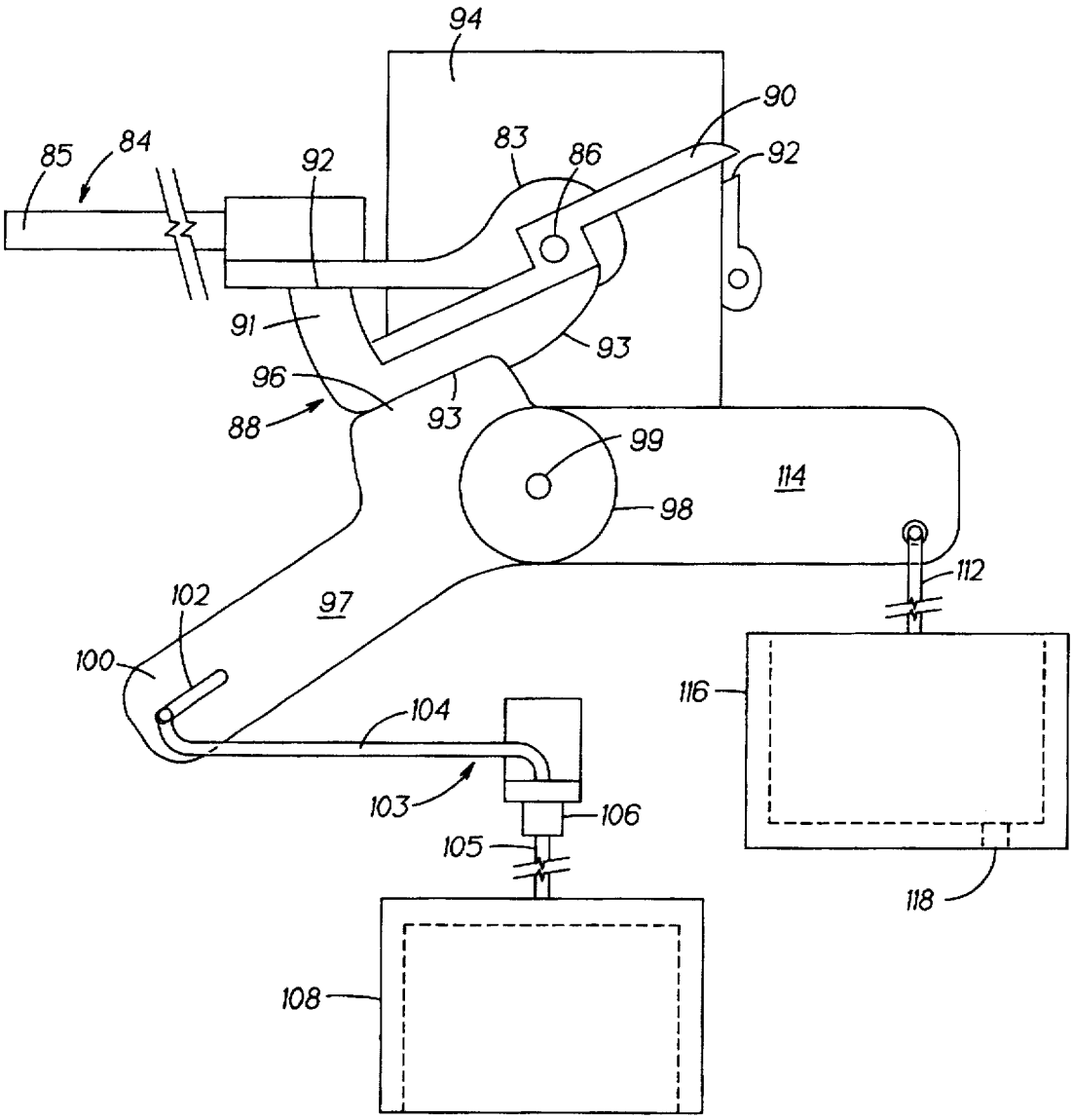
FIG. 5 is an elevational view of a first flush handle assembly.
Figure 6:
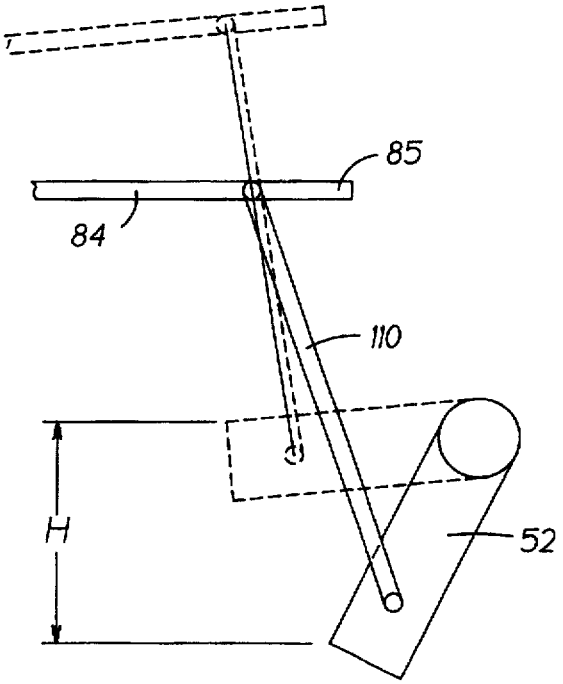
FIG. 6 is an elevational view illustrating the interconnection of the flush arm and the elbow.

Rotatably supported within a suitable bore (not shown) in the spindle 83 is a shaft 86 (FIG. 5). Secured to the shaft outside the tank is the inner flush handle 82 and secured to the free end of the shaft, within the tank, is a bracket 88 which has a rigid but resilient element 90 and a control element 91. Rotation of the inner handle, to flush the toilet, will be stopped, at a selected angular displacement, by the engagement of the resilient element with a stop 92 which is integral with a support plate 94 (the support plate is mounted on the spindle 83). The control element 91 has a flat top surface 92 supporting the flush arm 84 and a bottom surface 93 which has a notch 93. A correspondingly shaped projection 96 of a locking member 97 matingly engages this notch in the illustrated ready position. The locking member has a spindle 98 which is pivotally mounted on a post 99 integral with the support plate 94 and has a first outwardly extending arm 100 which has an extended slot 102 for receiving the bent end of a wire 103. This wire has a horizontal portion 104 and a vertical portion 105 which extends downwardly through a bore in a support bracket 106. The other end of this wire is secured, in an air tight manner, to a lifting cup 108 which is open at the bottom. When the water level rises beyond the bottom of the lifting cup, the air captured within the lifting cup will force the it to rise with the water level, thereby raising the wire which causes the locking member to rotate clockwise until it is stopped. At the ready position, upward movement is stopped by the insertion of the locking member projection 96 into the control element notch 93. At the fully up position, the locking member spindle 98 stops upward displacement of the wire. When the inner flush handle is operated (movement of the inner flush handle to its fully down location), the control element 91, and hence the flush arm 84 and the grid 36, will be displaced sufficiently to establish the siphon so that the toilet will flush. When the inner flush handle is operated, the projection 96 on the locking member will clear the notch 93 of the control element 91 and the upward bias of the lifting cup 108 will rotate the locking member 97 underneath the lower surface 93 of the control element 91 thereby holding the inner flush lever at its down position.

Connected proximate the free end of the flush arm 84 is one end of a rigid linkage 110 which is connected, at its other end, to the elbow 52 proximate its bottom. Rotational displacement of the control element 91 accordingly effects an upward pivotal displacement of the flush arm 84, and, hence the elbow, with a concomitant upward relocation of the bottom opening of the elbow (the initial position of the elbow may be slightly inclined to lessen the torque required to raise the elbow). When the bottom opening of the elbow is at this uppermost position (a vertical distance "H") a predetermined reduced flush volume will be defined.

A support 112, pivotally suspended from the right arm 114 of the locking member 97, supports at it free end, a timing cup 116 which is open at the top and which has an opening 118 defined in its bottom. The top of this timing cup is located below the water line so that it will be filled with water in the ready position and the size of the opening and the volume of the timing cup are defined so that once the locking member has been rotated to its fully rotated position, water in the timing cup will hold the locking member in the fully up position long enough for the siphon to be broken whereupon the locking member will rotate back to the ready position. As already described, a rigid link extends between the elbow 52 and the flush arm 84 so that the two structures pivot together. In a normal flush, the siphon compression spring returns the flush arm and the elbow to their initial positions before the water level drops to the bottom of the elbow. In a reduced volume flush, however, the locking member holds the flush arm at an elevated position and this results in the bottom opening of the elbow also being held at an elevated position until the water level lowers to this opening breaking the siphon. Thereafter, following the timing out of the timing cup, the locking member rotates to its initial location allowing the compression spring to lower the elbow and the flush arm to their initial locations. Accordingly, operation of the inner lever will result in the bottom of the elbow being relocated to its uppermost position to define a reduced volume flush and following that flush the locking member and the elbow will be returned to their initial locations.

Figure 7:
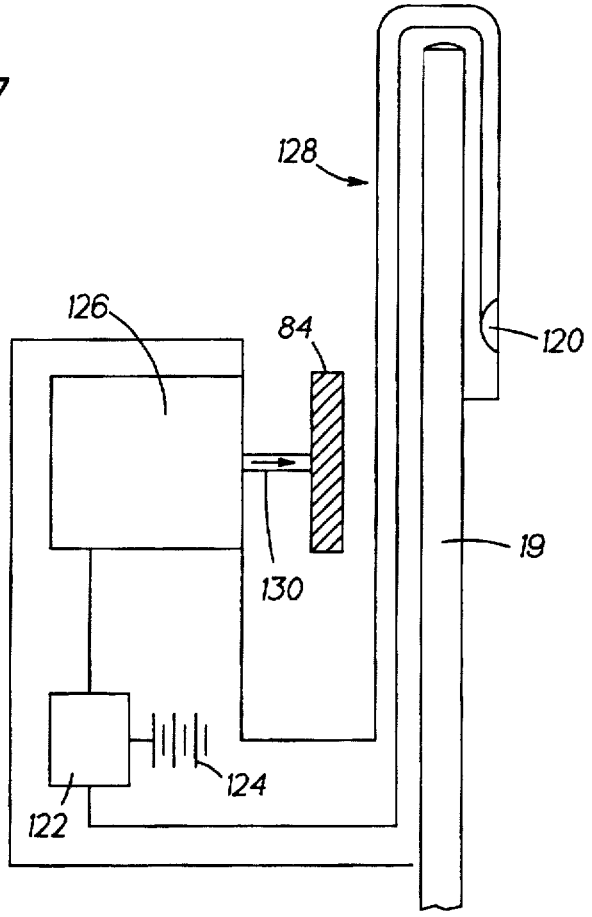
FIG. 7 is a side elevational view of a second flush handle assembly.
Figure 8:
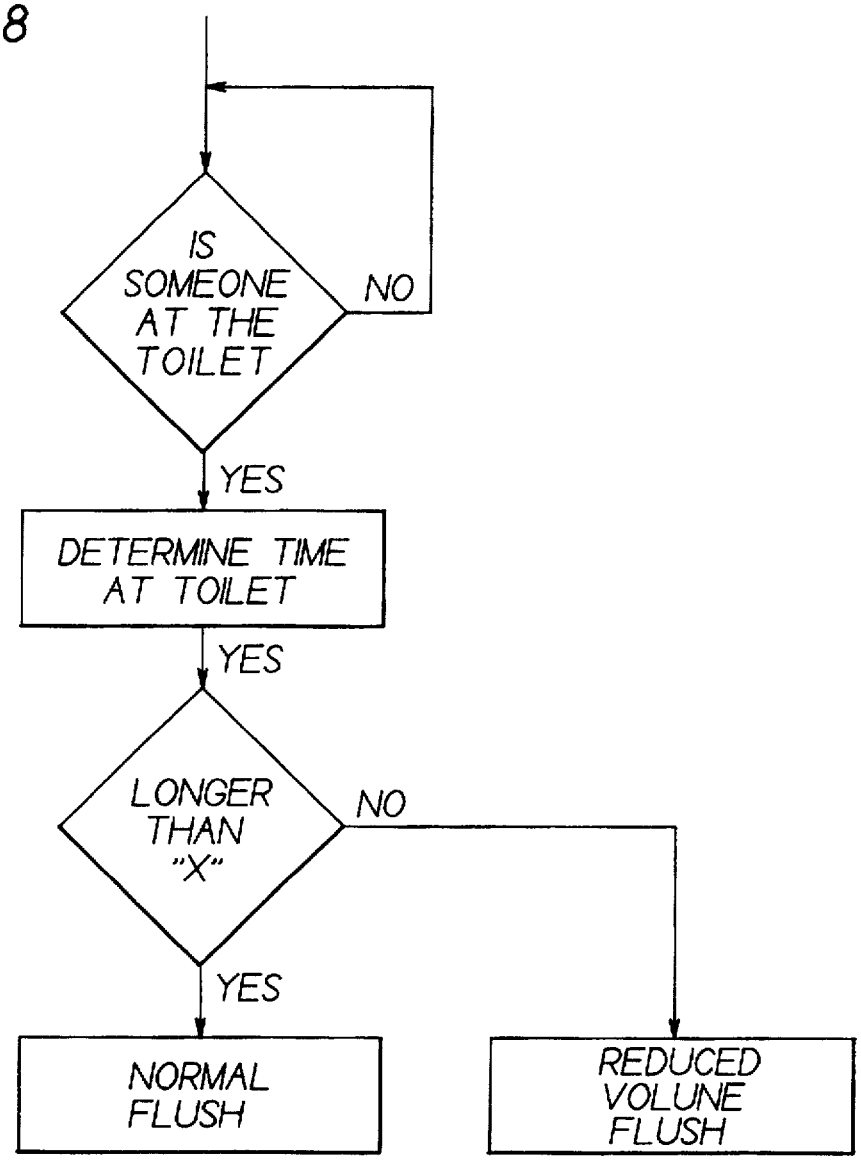
FIG. 8 is a logic diagram showing the control algorithm for the second flush handle assembly.

While, in the first flush handle assembly, a mechanical linkage and a water timer are disclosed, other structures could be utilized to vertically relocate the bottom opening of the elbow, to maintain that relocation until the siphon is broken, and then to return the elbow to its initial location. Referring to FIG. 7, a second flush handle assembly is shown which includes a proximity sensor 120 which is connected to a suitable control (chip) 122 which is powered by a battery 124 to operate a spring loaded solenoid 126. The sensor, control, battery and solenoid are supported by a suitable housing 128 which hangs on the front wall of the tank 19. The proximity sensor 120 senses the presence of a person at the toilet and the control determines the time that the person is at the toilet. In the event that the person is at the toilet less than "X" seconds the control will define a low volume flush. Otherwise it will define a normal 1.6 gallon flush.

The pin 130 of the solenoid is normally spring biased against the flush arm 84. When the flush handle (here there would only be a single flush handle) is operated, the flush arm will rise above the pin with the spring then advancing to its fully extended location. This generates a signal which tells the control that the toilet has been flushed. For a normal flush the solenoid will be operated to immediately fully retract the pin for a time sufficient to allow the flush arm to return to its initial location. The pin will then be released to advance the pin against the flush arm thereby resetting the assembly. For a reduced volume flush, when the control receives the signal that the pin has fully advanced, it does not operate the solenoid. Instead, as the siphon spring pulls the flush arm back down to its initial location, its downward displacement is stopped by the fully extended pin.

In a normal flush, the siphon compression spring returns the flush arm and the elbow to their initial positions before the water level drops to the bottom of the elbow. In a reduced volume flush, however, the pin holds the flush arm at an elevated position and this results in the bottom opening of the elbow also being held at an elevated position until the water level lowers to this opening breaking the siphon. Thereafter the control will operate the solenoid to fully retract the pin thereby allowing the compression spring to lower the elbow and the flush arm to their initial locations. After a period of time sufficient for this to happen, the solenoid is operated to reset the assembly.

What is claimed is:

1. A siphon assembly for use with a flush type toilet having a gravity tank with a drain hole at the bottom comprising a siphon including an inlet portion having a bell shaped portion and a connecting portion, a hole in said inlet portion, a tubular structure secured within said inlet portion hole, said tubular structure having an opening selectively located at a first position to break the siphon thereby defining the normal flush volume for the toilet, means for flushing the toilet with said opening at said first position, means for flushing the toilet with a reduced volume including means for vertically upwardly relocating said opening to a second position, means for maintaining said opening at said second position until the siphon is broken, and means for returning said opening to said first position following the breaking of the siphon.

2. A siphon assembly for use with a flush type toilet according to claim 1, wherein said tubular structure is an elbow pivotally secured within said inlet portion hole and terminating at an open end.

3. A siphon assembly for use with a flush type toilet according to claim 2, wherein said means for vertically upwardly relocating said opening to a second position comprises a flush handle assembly including a flush handle pivotally displaceable about a selected axis, a flushing arm displaceable by said flush handle from a ready position to a flush position, and a rigid linkage interconnecting said elbow and said flushing arm.

4. A siphon assembly for use with a flush type toilet according to claim 3, wherein said means for maintaining said opening at said second position until the siphon is broken comprises means for preventing the downward displacement of said flushing arm below a position selected to locate said elbow opening at said second position.

5. A siphon assembly for use with a flush type toilet according to claim 4, wherein said preventing means comprises a solenoid having a pin selectively advanceable into a downward path of said flushing arm.

6. A siphon assembly for use with a flush type toilet according to claim 5, wherein said means for returning said opening to said first position following the breaking of the siphon comprises means for retracting said pin.

7. A siphon assembly for use with a flush type toilet according to claim 6, wherein said pin is spring biased against said flushing arm when said flushing arm is at the ready position.

8. A siphon assembly for use with a flush type toilet according to claim 3, wherein said flush handle assembly further comprises a second flush handle assembly including a second flush handle pivotal about said selected axis, a control member pivotal about said selected axis from a ready position, said control member supporting said flushing arm, and means for stopping the pivotal displacement of said control member at an elevated position when said flushing arm has been elevated to a location whereat said opening has been relocated to said second position, and wherein said means for maintaining said opening at said second position until the siphon is broken comprises a locking element displaceable from a first position to a second position whereat the pivotal displacement of said control element from the elevated position towards said ready position will be prevented, and means for holding said locking element at said second position for a selected period of time.

9. A siphon assembly for use with a flush type toilet having a gravity tank with a drain hole at the bottom comprising a siphon, first means for flushing the toilet with a normal flush volume, second means for flushing the toilet with a reduced volume, and means for selectively operating either said first flushing means or said second flushing means including sensor means for sensing the presence of a person at the toilet.

10. A siphon assembly for use with a flush type toilet according to claim 9, wherein said siphon comprises an inlet portion having a bell shaped portion and a connecting portion, a hole in said inlet portion, a tubular structure secured within said inlet portion hole, said tubular structure terminating at an opening selectively located at a first position to break the siphon thereby defining the normal flush volume for the toilet, wherein said first means for flushing the toilet with a normal flush volume comprises means for flushing the toilet with said opening at said first position.

11. A siphon assembly for use with a flush type toilet according to claim 10, wherein said second means for flushing the toilet with a reduced volume comprises means for vertically upwardly relocating said opening to a second position, means for maintaining said opening at said second position until the siphon is broken, and means for returning said opening to said first position following the breaking of the siphon.

* * * * *